US008342580B2

(12) United States Patent
Cowie et al.

(10) Patent No.: US 8,342,580 B2
(45) Date of Patent: Jan. 1, 2013

(54) LOCK SYSTEM FOR A CONTAINER

(75) Inventors: Charles Henry Cowie, Jonesboro, AR (US); Richard A. Samsel, Haines City, FL (US)

(73) Assignee: Apex Brands, Inc., Sparks, MD (US)

( * ) Notice: Subject to any disclaimer, the term of this patent is extended or adjusted under 35 U.S.C. 154(b) by 1334 days.

(21) Appl. No.: 11/930,465

(22) Filed: Oct. 31, 2007

(65) Prior Publication Data

US 2008/0110893 A1 May 15, 2008

Related U.S. Application Data

(60) Provisional application No. 60/857,880, filed on Nov. 9, 2006.

(51) Int. Cl.
*E05C 9/00* (2006.01)
*E05B 67/00* (2006.01)

(52) U.S. Cl. ..... 292/32; 292/42; 292/104; 292/148; 292/177; 292/DIG. 63

(58) Field of Classification Search ..... 292/32, 292/33, 42, 104, 148, 163, 205, DIG. 63, 292/177–182
See application file for complete search history.

(56) References Cited

U.S. PATENT DOCUMENTS 1,558,099 A * 10/1925 Lebrun ..... 292/157
1,774,625 A * 9/1930 Alexander et al. ..... 292/162
3,334,933 A * 8/1967 Ehlers ..... 292/148
3,786,693 A 1/1974 Keipert
4,179,143 A * 12/1979 Shy ..... 292/179
4,234,220 A * 11/1980 Finch et al. ..... 292/148
4,397,389 A 8/1983 Findeisen
4,421,215 A 12/1983 Bellah et al.
4,501,378 A 2/1985 Berfield
4,547,006 A * 10/1985 Castanier ..... 292/37
4,613,175 A * 9/1986 Nelson ..... 292/148
4,802,351 A * 2/1989 Kojak ..... 70/56
4,807,687 A * 2/1989 Finch et al. ..... 160/133
5,100,015 A 3/1992 Vanderstuyf
5,235,830 A 8/1993 Benge
5,351,512 A * 10/1994 Pearlman ..... 70/257
5,791,174 A 8/1998 Fitzgerald et al.
6,115,239 A * 9/2000 Kim ..... 361/679.57
6,351,975 B1 * 3/2002 Valdes ..... 70/56
6,494,064 B1 12/2002 Pena
6,681,604 B1 * 1/2004 Samsel ..... 70/78
6,705,306 B1 3/2004 Dickey
6,772,613 B2 * 8/2004 Webb et al. ..... 70/159
6,851,288 B2 2/2005 Howes (Continued)

*Primary Examiner* — Carlos Lugo
(74) *Attorney, Agent, or Firm* — Nelson Mullins Riley & Scarborough, LLP

(57) ABSTRACT

A locking system includes a carrier member at least one locking member extending from the rod. The carrier member is movable between a first locked position in which the locking member engages a locking receptacle to maintain a container cover in a closed position and a second unlocked position in which the locking member disengages from the locking receptacle and the cover is movable between the closed and open position. The locking system includes a blocking member at a second end of the carrier member. The blocking member is movable between a first engaged position in which the rod abuts a portion of the blocking member and maintains the elongate rod in the first locked position and a second disengaged position in which the rod disengages from the blocking member and a biasing unit urges the rod in the second unlocked position.

28 Claims, 9 Drawing Sheets

U.S. PATENT DOCUMENTS

D524,633 S * 7/2006 Robert et al. ..... D8/339
7,090,094 B2 8/2006 Wade et al.
7,284,673 B2 10/2007 Habeger et al.
7,416,228 B2 8/2008 Pfitzinger et al.
7,418,846 B2 * 9/2008 James et al. ..... 70/159
7,494,418 B2 2/2009 Rifkin et al.
7,740,147 B1 6/2010 Gilbert
8,096,152 B2 * 1/2012 Wagh et al. ..... 70/56
2001/0032848 A1 10/2001 Jones et al.
2006/0230795 A1 * 10/2006 Kroening ..... 70/159
2007/0228741 A1 * 10/2007 Park et al. ..... 292/163
2007/0296225 A1 * 12/2007 Ashton et al. ..... 292/163
2008/0184598 A1 8/2008 Handel et al.
2010/0050712 A1 3/2010 Tong et al.
2011/0179720 A1 * 7/2011 Zijlstra ..... 49/503

* cited by examiner

LOCK SYSTEM FOR A CONTAINER

RELATED APPLICATIONS

This application claims priority to U.S. Provisional Application Ser. No. 60/857,880, filed Nov. 9, 2006, the disclosure of which is incorporated herein by reference in its entirety.

FIELD OF THE INVENTION

The present invention relates to containers, and in particular, to locking systems for construction storage boxes.

BACKGROUND OF THE INVENTION

Large storage containers, including boxes and cabinets, used in the construction industry are often formed of steel sheet. The floor, walls and ceiling (or lid) of the container can be formed either from a single sheet of steel that is bent at intersecting edges of these surfaces or from multiple pieces of sheet steel that are welded together. Many containers have bolsters underlying the floor, and some will include castors beneath the bolsters. Typical sizes for such a cabinet or box can range from 5 $ft^3$ to 150 $ft^3$ or even larger. Exemplary storage containers include those sold under the name JOBOX™ by Delta Consolidated Industries, Jonesboro, Ark. and those sold under the name JOBMASTER™ by Knaack Manufacturing, Crystal Lake, Ill.

For protection of tools stored inside the container cavity, the typical container has a cover, also formed of sheet steel, that is attached via a hinge to the rear wall of the box portion of the container. Such a cover pivots between a closed position covering the cavity and an open position that allows access to the cavity. The cover should have sufficient strength and durability to withstand the abuse a chest typically endures, including the stacking of heavy objects on the lid.

Horizontal lock systems in which the latching mechanism for the cover is operated from one end of the tool box using a padlock are known. See, e.g., U.S. Pat. No. 6,772,613 to Webb et al. An elongated latch rod is typically slidably disposed adjacent a front wall of the body of the container. The padlock and the elongated latch rod are positioned such that the padlock body blocks the longitudinal movement of the latch rod in the latched position when the container is in the closed position and the padlock is locked, but an end of the latch rod passes between the shackle and the padlock body to move the latch rod to a release position when the padlock is unlocked.

Horizontal lock systems typically require an operator to manually move the latch rod between the latched position and the release position after the padlock is unlocked. Accordingly, unlocking the container may be cumbersome because the operator generally needs to both unlock the padlock and manually move the latch rod. In addition, it may be difficult to determine visually whether the container is locked or unlocked.

SUMMARY OF THE INVENTION

According to embodiments of the invention, a container includes a receptacle having walls, a floor, and an open end. A cover is pivotally attached to one of the walls of the receptacle. The cover is movable between an open position, in which the open end of the receptacle can be accessed, and a closed position, in which the cover overlies the open end of the receptacle. A locking receptacle is mounted on one of the cover and one or more of the receptacle walls. The container includes a locking system for maintaining the cover in the closed position. The locking system includes an carrier member having at least one locking member extending from the carrier member, the carrier member being movable between a first locked position in which the locking member engages the locking receptacle to maintain the cover in the closed position and a second unlocked position in which the locking member disengages from the locking receptacle and the cover is movable between the closed and the open position. A biasing unit is attached to the carrier member. The biasing unit is configured to bias the carrier member toward the unlocked position. The locking system includes a blocking member at an end of the carrier member. The blocking member is movable between a first engaged position, in which the carrier member abuts a portion of the blocking member and maintains the elongate rod in the first locked position, and a second disengaged position, in which the carrier member disengages from the blocking member and the biasing unit urges the carrier member in the second unlocked position.

In certain embodiments, the locking assembly includes a locking indicator assembly having an indicium on an external portion of the container and a movable member connected to the carrier member. The movable member overlies the indicium when the carrier member is in at least one of the first locked position and the second unlocked position. In some embodiments, at least a portion of the indicium is not covered by the movable member when the carrier member is in the other of the first locked position and the second unlocked position.

In particular embodiments, the locking system is mounted on the cover and the locking receptacles are mounted on at least one of the container sidewalls.

In some embodiments, the locking system includes at least one tab adjacent one of the locking members. In particular embodiments, the blocking member is a padlock. The padlock can include a body portion and a shackle so that when the shackle disengages from the padlock body portion, the first end of the carrier member is positioned between the shackle and the padlock body and the carrier member is in the second unlocked position. The container can further include padlock housing configured to house the padlock and a bracket mounted in the housing, the bracket having an aperture for receiving the padlock shackle therein.

In some embodiments, the receptacle is formed of sheet metal. The carrier member can be an elongate rod.

According to further embodiments of the present invention, a container includes a receptacle having walls, a floor, and an open end. A cover is pivotally attached to one of the walls of the receptacle. The cover is movable between an open position, in which the open end of the receptacle can be accessed, and a closed position, in which the cover overlies the open end of the receptacle. A locking receptacle is mounted on one of the cover and one or more of the receptacle walls. The container includes a locking system for maintaining the cover in the closed position. The locking system includes a carrier member having at least one locking member extending from the carrier member. The carrier member is movable between a first locked position in which the locking member engages the locking receptacle to maintain the cover in the closed position and a second unlocked position in which the locking member disengages from the locking receptacle and the cover is movable between the closed and the open position. A blocking member is at a second end of the carrier member. The blocking member is movable between a first engaged position in which the carrier member abuts a portion of the blocking member and maintains the carrier member in the first locked position and a second disengaged position in which the carrier member disengages from the blocking member is movable to the second unlocked position. The locking system further includes a locking indicator assembly having an indicium on an external portion of the container and a movable member connected to the carrier member. The movable member overlies the indicium when the carrier member is in at least one of the first locked position and the second unlocked position.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF THE INVENTION

Figure 1:
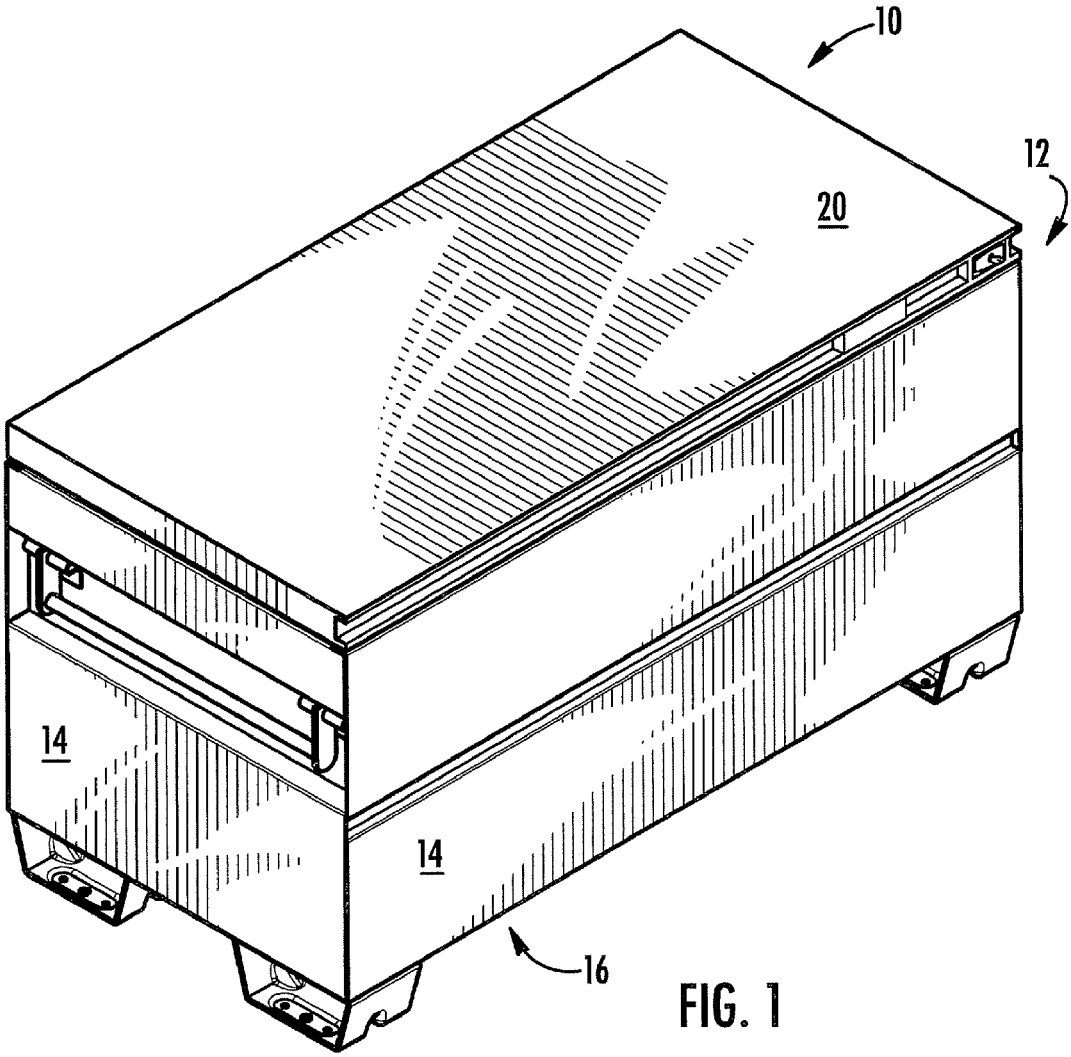
FIG. 1 is a top perspective view of a container according to embodiments of the current invention.

The present invention now will be described hereinafter with reference to the accompanying drawings and examples, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a stricture or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a "first" element, component, region, layer or section discussed below could also be termed a "second" element, component, region, layer or section without departing from the teachings of the present invention. The sequence of operations (or steps) is not limited to the order presented in the claims or figures unless specifically indicated otherwise.

Figure 2:
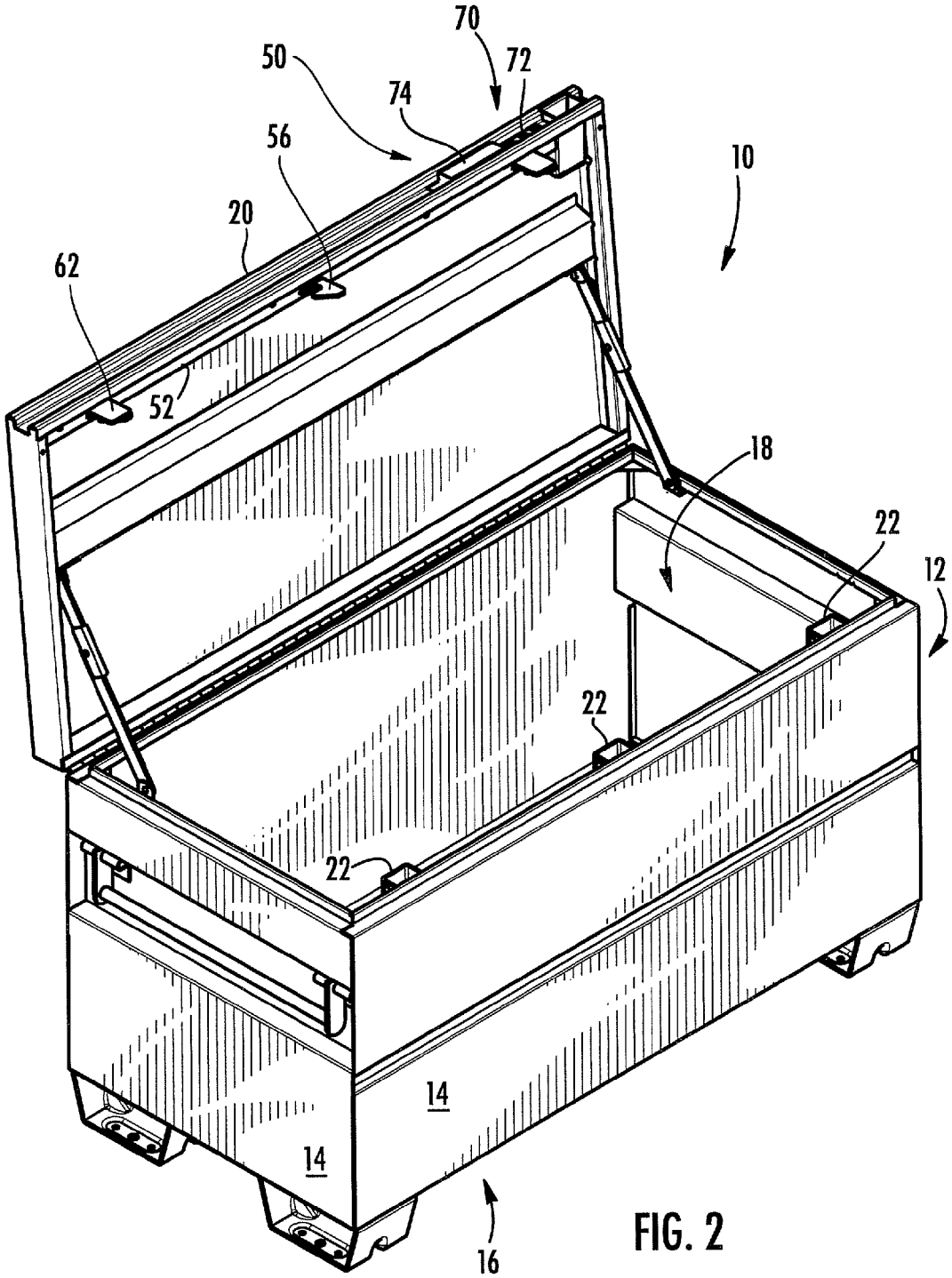
FIG. 2 is a top perspective view of the container of FIG. 1 with the lid in the open position.

Referring to FIGS. 1-9, a container 10 includes a receptacle 12 having side walls 14, a floor 16, and an open end 18 (FIG. 2). A cover 20 is pivotally attached to one of the walls 14 and is movable between an open position shown in FIG. 2, in which the open end of the receptacle can be accessed, and a closed position shown in FIG. 1, in which the cover 20 overlies the open end 18 of the receptacle 12. As shown in FIG. 2, locking receptacles 22 are mounted on at least one of the walls 14. The receptacle 12 may be formed of sheet metal.

As shown in FIGS. 2-5, the container 10 includes a locking system 50. The locking system 50 has a carrier member or elongate rod 52 with two ends 52*a*, 52*b* and a spring 54 at the end 52*a* and locking members 56 extending from the rod 52. The rod 52 is mounted in a casing 80 by brackets 82. The casing 80 includes tabs 58 adjacent the locking members 56 of the rod 52.

Figure 4:
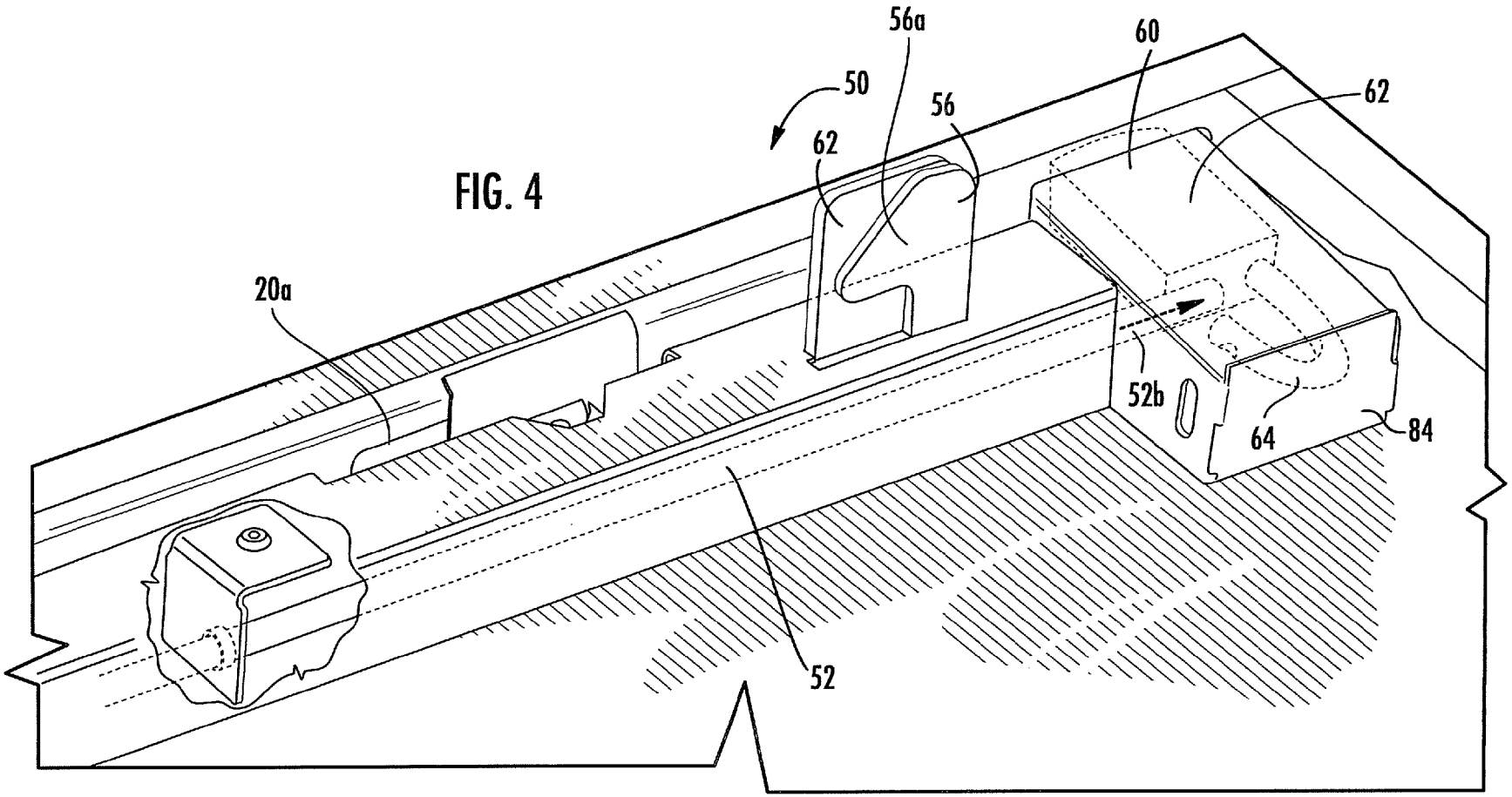
FIG. 4 is an enlarged detailed bottom perspective view of the locking system of FIG. 3 in an unlocked position.
Figure 5:
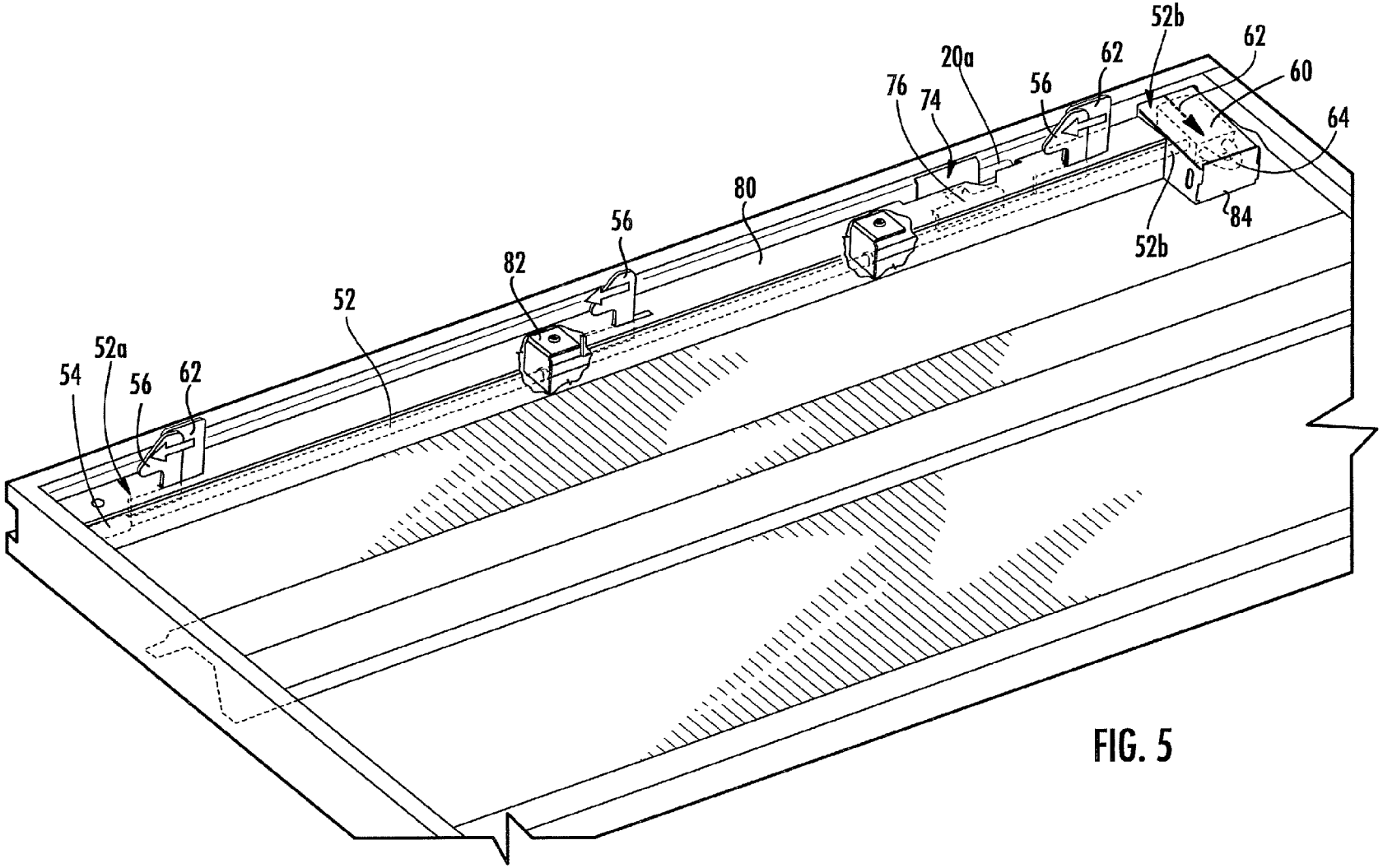
FIG. 5 is a bottom perspective view of the locking system of FIG. 3 in a locked position.
Figure 6:
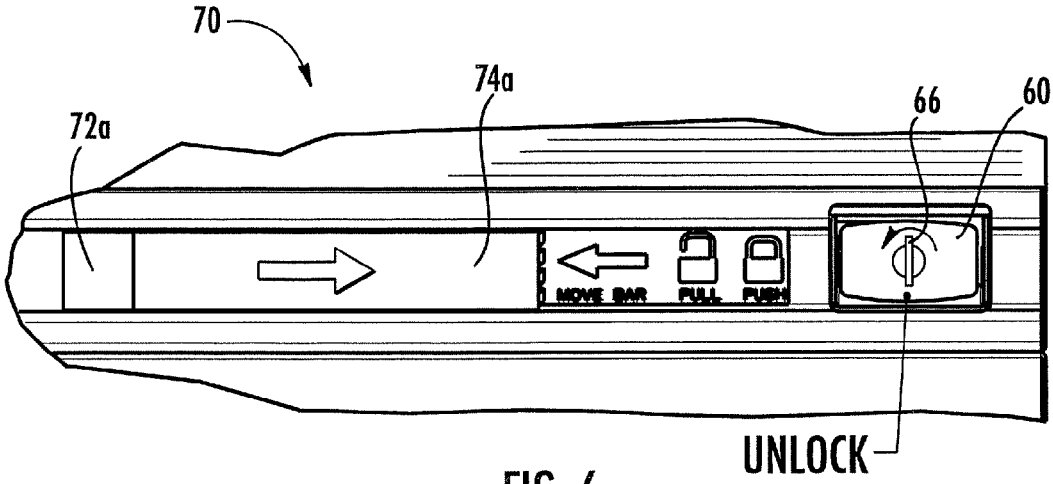
FIG. 6 is an enlarged front view of the box of FIG. 1 with the locking system of FIG. 3 in the unlocked position.
Figure 7:
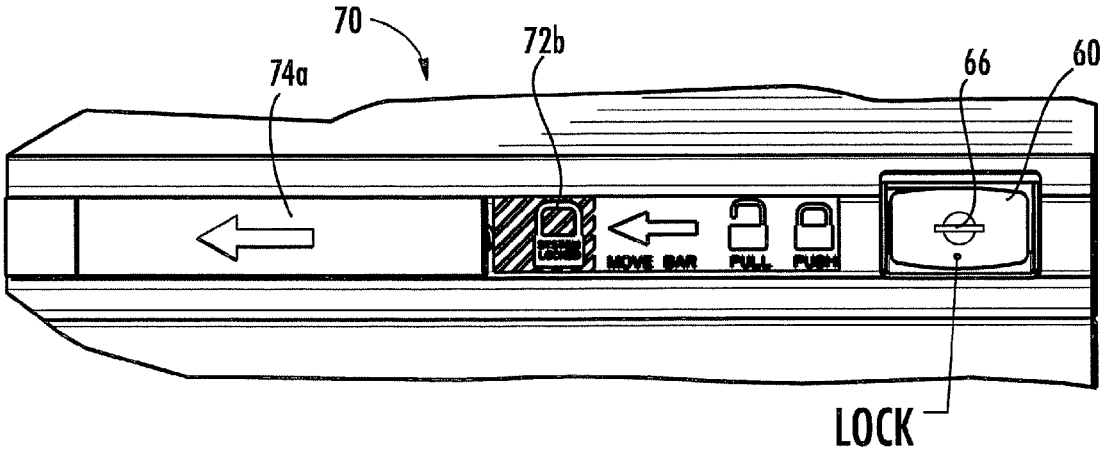
FIG. 7 is an enlarged front view of the box of FIG. 1 with the locking system of FIG. 3 in the locked position.
Figure 8:
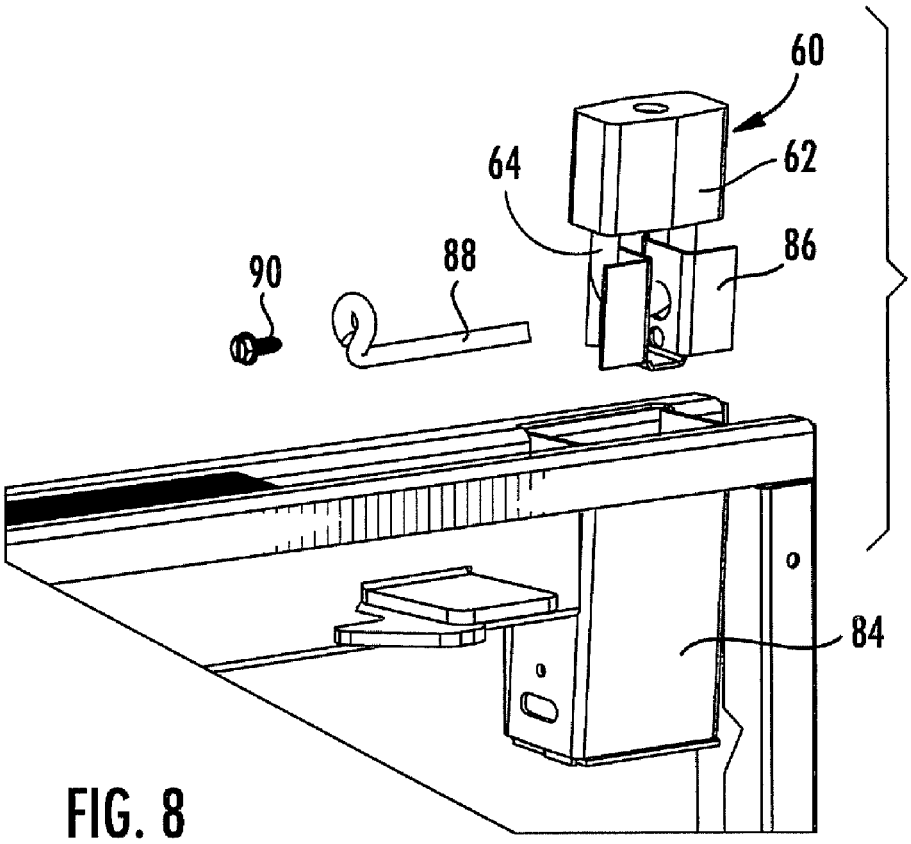
FIG. 8 is a bottom exploded perspective view of the padlock and locking components of the locking system of FIG. 3.
Figure 9:
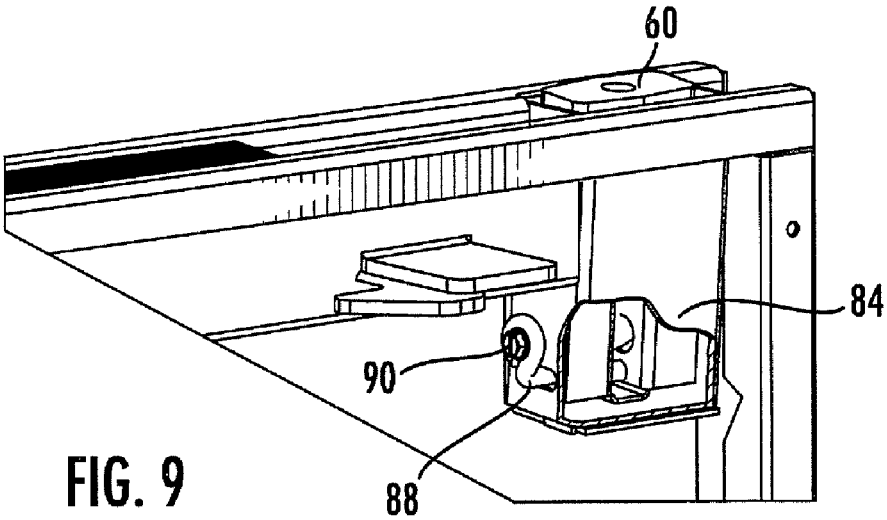
FIG. 9 is a cut-away perspective view of the padlock and locking components of FIG. 8.

Referring to FIGS. 3-7, the locking system 50 further includes a blocking member or padlock 60 that is held by a housing 84 at the end 52*b* of the rod 52 opposite the spring 54. The padlock 60 includes a body 62, a shackle 64 and a key 66 (FIGS. 6 and 7). With reference to FIGS. 8 and 9, the padlock 60 is held in the housing 84 by a bracket 86 that fits within the housing 84, a pin 88 that extends through the housing 84 and the bracket 86, and a screw 90 that mounts the pin 88 to the wall of the housing 84. The shackle 64 of the padlock 60 extends through an aperture in the bracket 86.

Figure 3:
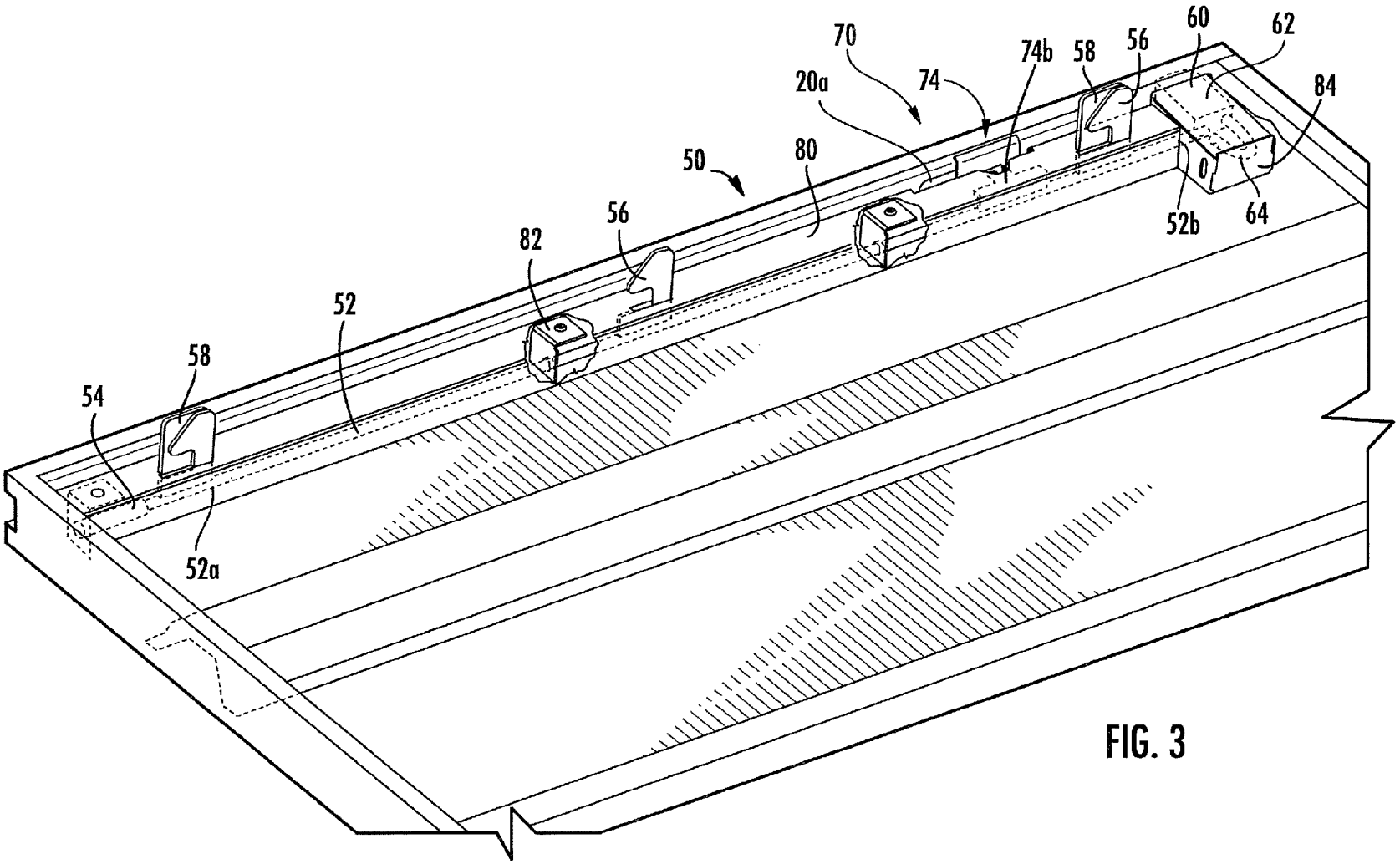
FIG. 3 is a bottom perspective view of a locking system of the container of FIG. 1.

As shown in FIGS. 6 and 7, the locking system 50 includes a locking indicator assembly 70 that has locking indicia 72*a*, 72*b* and a slidable bar assembly 74. The indicia 72*a*, 72*b* can be any indicator that is visible to an operator to indicate whether the locking system 50 is in the locked or unlocked state. Examples of suitable indicia 72*a*, 72*b* include a color, a logo, a symbol, text, etc. As shown in FIGS. 3-5, the slidable bar assembly 74 includes a connecting member 74*b* for connecting the bar 74*a* shown in FIGS. 6 and 7 to the rod 52 of FIGS. 3-5.

In this configuration, the elongated rod 52 is movable between a locked position shown in FIG. 5 and an unlocked position shown in FIGS. 3-4. When the cover 20 is in the closed position and the rod 52 is in the locked position of FIG. 5, the locking members 56 engage the corresponding locking receptacles 22 to maintain the cover 20 in the locked position. When the elongate rod 52 is in the unlocked position of FIGS. 3 and 4, the locking members 56 disengage from the locking receptacles 22 so that the cover 20 is movable between the open and closed positions.

In particular, when the padlock 60 is unlocked as shown in FIGS. 3 and 4, the body 62 of the lock 60 can be moved away from the loop end of the shackle 64. As such, the body 62 moves out of the path of the rod 52, such that the rod end 52*b* is disengaged from the padlock body 62. The spring 54, which is in compression, urges the rod 52 to the unlocked position in which the rod end 52*b* passes between the padlock body 62 and the shackle 64. In this disengaged/unlocked position, the locking members 56 are positioned so as to not engage the locking receptacles 22 shown in FIG. 2, and, consequently, the cover 20 is free to move between the open and closed positions.

The rod 52 may be moved to the locked position in the direction indicated in FIG. 5, for example, by an operator moving the sliding bar 74. When the operator locks the padlock 60, the rod end 52*b* abuts the padlock body 62, and the rod 52 compresses the spring 54. In this position, the padlock body 62 engages the rod end 52*b* to substantially prevent movement of the rod 52 in the lateral direction, which maintains the rod 52 in the locked position of FIG. 5. When the rod 52 is in the locked position, the locking members 56 are moved to a position in which they engage the locking receptacles 22 when the cover 20 is closed so as to maintain the cover 20 in the closed position. For example, the locking receptacles 22 may include a flange, surface or pin that engages the hook 56*a* of the locking members 56 when the locking members 56 and the rod 52 are in the locked position of FIG. 5.

When an operator unlocks the padlock 60, the spring 54 urges the rod end 52*b* between the padlock body 62 and the shackle 64 such that the rod 52 is automatically moved to the unlocked position shown in FIGS. 3 and 4. In this configuration, the locking members 56 are biased toward the unlocked position.

When the rod 52 is in the unlocked position of FIGS. 3 and 4, the locking members 56 are aligned with the tabs 58. If an unauthorized user attempts to pry the cover to gain sufficient access to manually unlatch the locking members 56, the tabs 58 may reduce or block this access and maintain the security of the locking members 56. When the tabs 58 are in the locking receptacles 22 and the lid 20 is locked, the tabs 58 are fixed to the lid 20 and fit closely inside the locking receptacle 22 (which is fixed to the wall 14) and generally prevents the lid 20 from being pried or urged left to right.

Referring to FIGS. 6 and 7 and FIGS. 10 and 11, the rod 52 is connected via the connecting member 74*b* to the slidable bar 74 of the locking indicator assembly 70, which is visible from an external portion of the container 10. As shown in FIG. 6, when the padlock 60 is in the unlocked position (and the rod 52 is in the corresponding unlocked position of FIGS. 3-4), the indicium 72*a* is visible. Accordingly, an operator can determine that the container cover 20 is unlocked by visually observing the indicium 72*a*. As shown in FIG. 7, when the padlock 60 is moved to the locked position (and the rod 52 is in the corresponding locked position of FIG. 5), the slidable bar 74 is moved in the direction indicated in FIG. 7 and covers the indicium 72*a*. The movement of the slidable bar 74 to the locked position in FIG. 7 uncovers the indicium 72*b*. Therefore, an operator can determine that the container cover 20 is locked by visually observing the indicium 72*b*.

In this configuration, when the padlock 60 is unlocked, the spring 54 urges the rod 52 and the bar 74 automatically to the unlocked position of FIGS. 3 and 4 and FIG. 6. Consequently, the slidable bar 74 reveals the indicium 72*a*, which is a visible indication that the cover 20 is unlocked. By configuring the locking system 50 such that it is biased to the unlocked position, it should be clear to a user that the container 10 is unlocked because of the presence and visibility of the indicium 72*a*.

Figure 10:
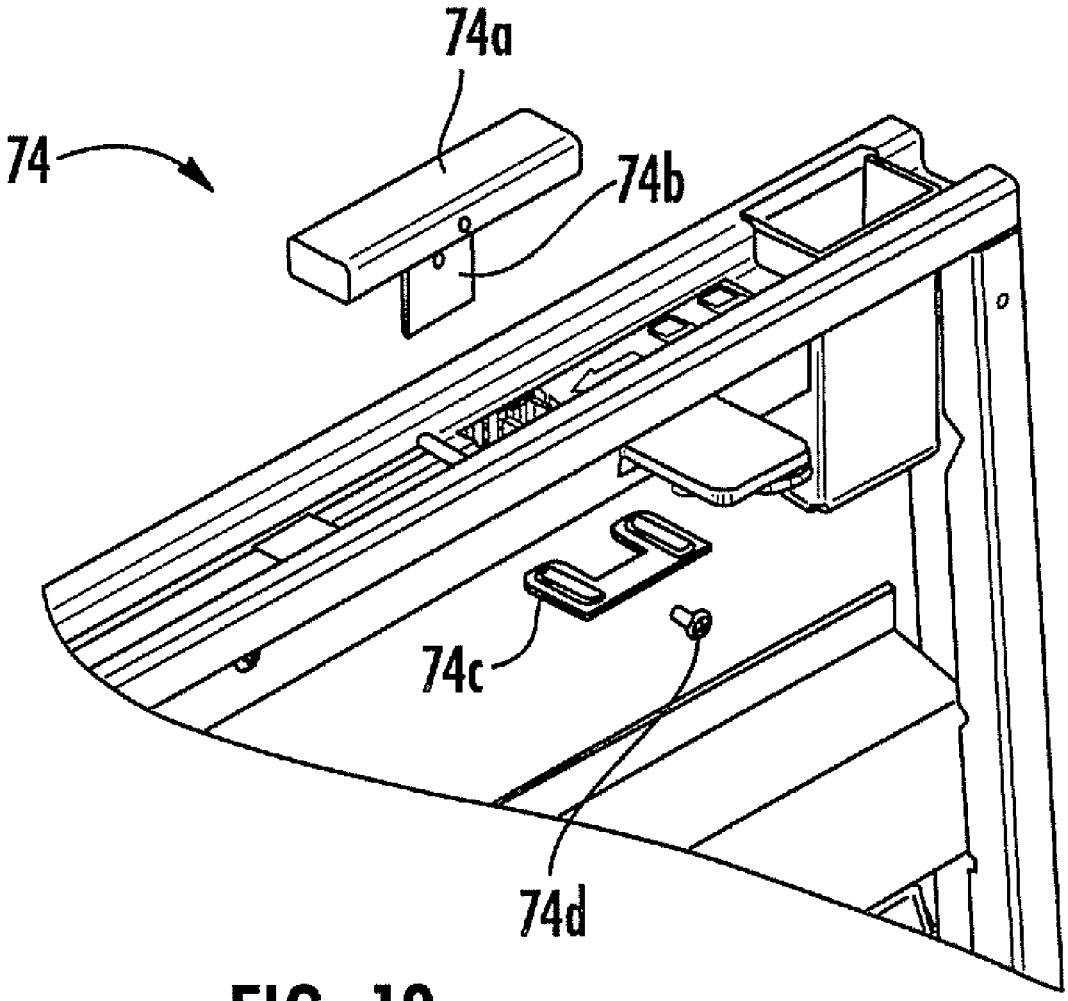
FIG. 10 is an enlarged exploded perspective view of a slidable member assembly for the locking assembly of FIGS. 6-7.
Figure 11:
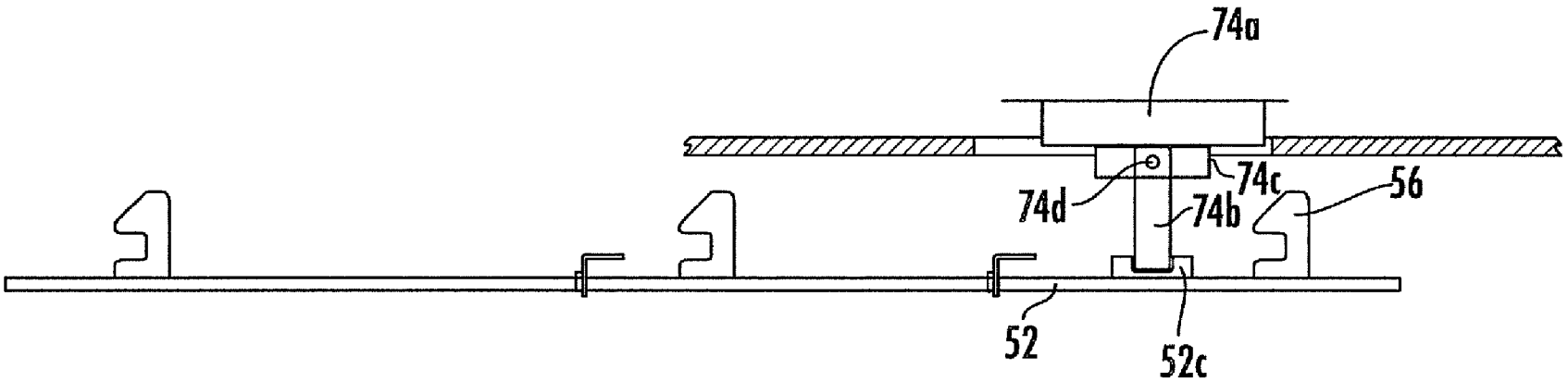
FIG. 11 is a top view of the slidable member assembly of FIG. 10.

As illustrated in FIGS. 10 and 11, the slidable bar 74*a* of the slidable bar assembly 74 can be connected to a receiving member 52*c* on the rod 52 via the connecting member 74*b*. A brace 74*c* is connected to the connecting member 74*b* by a fastener, such as a rivet 74*d*, which holds the connecting member 74*b* on a notch 20*a* in the cover 20 as shown in FIGS. 3-5. The connecting member 74*b* is received in the receiving member 52*c* of the rod 52 so that the bar 74*a* moves with the rod 52 between a locked and an unlocked position.

Those skilled in this art will recognize that the container 10 may take other configurations. For example, although the locking indicator assembly 70 is illustrated with respect to indicia 72*a*, 72*b*, it should be understood that one of the indicia 72*a*, 72*b* may be omitted so that the other of the indicia 72*a*, 72*b* is visible when the padlock 60 is in one of the unlocked or locked positions.

Although the locking assembly 50 is illustrated with respect to the spring 54 at an end 52*a* of the rod 52, it should be understood that other biasing units, such as a gas spring or cylinder, or an elastomeric member could be used. Moreover, the spring 54 or other biasing unit could be located along the middle portion or on the other end 52*b* of the rod 52. The spring 54 or other biasing unit can be biased to a locked or an unlocked position. In some embodiments, the cover 20 is biased to an open position, and the spring 54 is biased to a locked position; however, the cover 20 may be biased to a closed position and/or the spring may be biased to an unlocked position. The rod 52 may be any carrier member for moving a locking member between an unlocked and locked position, including a nonlinear or bent member. The hooks 56*a* of the locking members 56 may be any suitable size and configuration that maintains the cover 20 in a closed position (such as when the locking members 56 mate with locking receptacles 22). However, the tapered shape of the hooks 56*a* may reduce impact forces to the locking system 50 when the cover 20 is closed.

The slidable bar assembly 74 can include any suitable movable member for overlying and revealing the indicia 72*a*, 72*b*. For example, the slidable bar 74 could be replaced with a rotary member that moves in a rotational direction with the rod 52 (or other carrier member) to reveal or overlie a visible indicium, and can be connected to the rod 52 or other carrier member using various configurations. For example, the connecting member 74*b* may be connected to the rod 52 by welding or other fasteners.

As illustrated in FIGS. 1-9, the locking system 50 is mounted on the cover 20 and the locking receptacles 22 is mounted on the receptacle walls 14. However, in some embodiments, the locking system 50 and locking indicator assembly 70 may be mounted on the receptacle walls 14 and the locking receptacles 22 may be mounted on the cover 20.

The locking system 50 may structurally reinforce the strength of the cover 20.

Moreover, although the padlock 60 is illustrated as a blocking or abutting the rod end 52*b* in FIG. 5, other suitable configurations may be used to block the rod end 52*b* and maintain the rod 52 in the locked position. The padlock 60 may be positioned in any suitable orientation. For example, the padlock 60 may be rotated about ninety degrees with respect to the horizontal plane of the cover 20. In addition, the padlock 60 may directly or indirectly block the rod end 52*b*. For example, the padlock 60 may be attached to another component, such as a metal plate or sleeve, which blocks the rod end 52*b* when the padlock 60 is in the locked position.

The housing 84 may be sealed so that water drains out the front of the container 10 away from the inside of the receptacle 12.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A container, comprising:

a receptacle having walls, a floor, and an open end;

a cover pivotally attached to one of the walls of the receptacle, the cover being movable between an open position, in which the open end of the receptacle can be accessed, and a closed position, in which the cover overlies the open end of the receptacle;

a locking receptacle mounted on one of the cover and one or more of the receptacle walls; and a locking system for maintaining the cover in the closed position, the locking system mounted on the other of the cover and the one or more of the receptacle walls, comprising:

a carrier member having at least one locking member extending from the carrier member, the carrier member being movable between a first locked position in which the locking member engages the locking receptacle to maintain the cover in the closed position and a second unlocked position in which the locking member disengages from the locking receptacle and the cover is movable between the closed and the open position;

a biasing unit attached to one end of the carrier member, the biasing unit configured to bias the carrier member toward the unlocked position;

a blocking member disposed at an opposite end of the carrier member, the blocking member being positioned between a first engaged position, in which the carrier member abuts a portion of the blocking member, thereby maintaining the carrier member in the first locked position, and a second disengaged position in which the carrier member disengages from the blocking member and the biasing unit urges the carrier member to the second unlocked position; and a locking indicator assembly having an indicium on an external portion of the container and a movable member connected to the carrier member to move the carrier member between the first locked position and second unlocked position, wherein the movable member overlies the indicium when the carrier member is in at least one of the first locked position and the second unlocked position.

2. The container of claim 1, wherein at least a portion of the indicium is not covered by the slidable member when the carrier member is in the other of the first locked position and the second unlocked position.

3. The container of claim 1, wherein the locking system is mounted on the cover and the locking receptacles are mounted on at least one of the container sidewalls.

4. The container of claim 1, wherein the blocking member comprises a padlock.

5. The container of claim 4, wherein the padlock comprises a body portion and a shackle so that when the shackle disengages from the padlock body portion, a portion of the carrier member is positioned between the shackle and the padlock body and the carrier member is in the second unlocked position.

6. The container of claim 5, further comprising a padlock housing configured to house the padlock and a bracket mounted in the housing, the bracket having an aperture for receiving the padlock shackle therein.

7. The container of claim 1, wherein the receptacle is formed of sheet metal.

8. The container of claim 1, wherein the carrier member is an elongated rod.

9. A container, comprising:

a receptacle having walls, a floor, and an open end;

a cover pivotally attached to one of the walls of the receptacle, the cover being movable between an open position, in which the open end of the receptacle can be accessed, and a closed position, in which the cover overlies the open end of the receptacle;

a locking receptacle mounted on one of the cover and one or more of the receptacle walls;

a locking system for maintaining the cover in the closed position, the locking system mounted on the other of the cover and the one or more of the receptacle walls, comprising:

a carrier member having at least one locking member extending from the carrier member, the carrier member being movable between a first locked position in which the locking member engages the locking receptacle to maintain the cover in the closed position and a second unlocked position in which the locking member disengages from the locking receptacle and the cover is movable between the closed and the open position;

a blocking member disposed at a first end of the carrier member, the blocking member being positioned between a first engaged position in which the carrier member abuts a portion of the blocking member, thereby maintaining the carrier member in the first locked position and a second disengaged position in which the carrier member disengages from the blocking member and is movable to the second unlocked position; and a locking indicator assembly having an indicium on an external portion of the container and a movable member connected to the carrier member to move the carrier member between the first locked position and second unlocked position, wherein the movable member overlies the indicium when the carrier member is in at least one of the first locked position and the second unlocked position.

10. The container of claim 9, wherein the indicium is not covered by the movable member when the carrier member is in the other of the first locked position and the second unlocked position.

11. The container of claim 9, further comprising a biasing unit attached to a second end of the carrier member that urges the carrier member to the second unlocked position when the blocking member is in the second disengaged position.

12. The container of claim 9, wherein the locking system is mounted on the cover and the locking receptacles are mounted on at least one of the container sidewalls.

13. The container of claim 9, further comprising at least one tab adjacent one of the locking members, wherein the at least one tab is substantially aligned with one of the locking members so as to prevent engagement of the locking receptacle with the locking member when the carrier member is in the second unlocked position.

14. The container of claim 9, wherein the blocking member comprises a padlock.

15. The container of claim 14, wherein the padlock comprises a body portion and a shackle so that when the shackle disengages from the padlock body portion, the first end of the carrier member is positioned between the shackle and the padlock body and the carrier member is in the second unlocked position.

16. The container of claim 15, further comprising a padlock housing configured to house the padlock and a bracket mounted in the housing, the bracket having an aperture for receiving the padlock shackle therein.

17. The container of claim 9, wherein the receptacle is formed of sheet metal.

18. A locking system for maintaining a cover of a container in a closed position, the container including a receptacle having walls, a floor, and an open end and a cover pivotally attached to one of the walls of the receptacle, the cover being movable between an open position, in which the open end of the receptacle can be accessed, and a closed position, in which the cover overlies the open end of the receptacle, the container including a locking receptacle mounted on one of the cover and one or more of the receptacle walls, the locking system being mounted on the other of the cover and the one or more of the receptacle walls, comprising:

an elongated rod having a spring at a first end thereof and at least one locking member extending from the rod, the elongated rod being movable between a first locked position in which the locking member engages the locking receptacle to maintain the cover in the closed position and a second unlocked position in which the locking member disengages from the locking receptacle and the cover is movable between the closed and the open position;

a blocking member at a second end of the elongated rod, the blocking member being positioned between a first engaged position in which the rod abuts a portion of the blocking member, thereby maintaining the elongated rod in the first locked position and a second disengaged position in which the rod disengages from the blocking member and the spring urges the rod to the second unlocked position; and a locking indicator assembly having an indicium configured for positioning on an external portion of the container and a slidable member connected to the elongate rod to move the carrier member between the first locked position and the second unlocked position, wherein the slidable member overlies the indicium when the elongate rod is in at least one of the first locked position and the second unlocked position.

19. A container, comprising:

a receptacle having walls, a floor, and an open top end;

a cover pivotally attached to one of the walls of the receptacle, the cover being movable between an open position, in which the open end of the receptacle can be accessed, and a closed position, in which the cover overlies the open end of the receptacle;

a first set of at least three engagement members mounted on one of the cover and one or more of the receptacle walls;

a locking system for maintaining the cover in the closed position, the locking system being mounted on the other of the cover and the one or more of the receptacle walls, comprising:

a carrier member having a second set of at least three engagement members extending from the carrier member and corresponding to the first set of at least three engagement members, the carrier member being movable between a first locked position in which the second set of at least three engagement members engage the first set of at least three engagement members to maintain the cover in the closed position and a second unlocked position in which the first set of at least three engagement members disengage from the second set of at least three engagement members and the cover is movable between the closed and the open position; and a locking indicator assembly having an indicium on an external portion of the container and a movable member connected to the carrier member to move the carrier member between the first locked position and the second unlocked position, wherein the movable member overlies the indicium when the carrier member is in at least one of the first locked position and the second unlocked position.

20. The container of claim 19, further comprising a casing that covers at least part of the carrier member.

21. The container of claim 19, wherein the first set of at least three engagement members are mounted on the one of the receptacle walls and the locking system is mounted on the cover.

22. The container of claim 19, wherein the locking system further comprises:

a blocking member disposed at a first end of the carrier member, the blocking member being positioned between a first engaged position in which the carrier member abuts a portion of the blocking member, thereby maintaining the carrier member in the first locked position and a second disengaged position in which the carrier member disengages from the blocking member and is movable to the second unlocked position.

23. The container of claim 19, wherein the carrier member slides to move between the first locked position and the second unlocked position.

24. The container of claim 19, further comprising a padlock that engages the carrier member in the first locked position.

25. A container, comprising:

a receptacle having walls, a floor, and an open end;

a cover pivotally attached to one of the walls of the receptacle, the cover being movable between an open position, in which the open end of the receptacle can be accessed, and a closed position, in which the cover overlies the open end of the receptacle;

at least one locking receptacle mounted on one of the cover and one or more of the receptacle walls;

a locking system for maintaining the cover in the closed position, the locking system being mounted on the other of the cover and the one or more of the receptacle walls, comprising:

a carrier member having at least one locking member extending from the carrier member and corresponding to the at least one locking receptacle, the carrier member being movable between a first locked position in which the at least one locking member engages the at least one locking receptacle to maintain the cover in the closed position and a second unlocked position in which the at least one locking member disengages from the at least one locking receptacle and the cover is movable between the closed and the open position;

a casing that covers at least part of the carrier member; and a locking indicator assembly having an indicium on an external portion of the container and a movable member connected to the carrier member to move the carrier member between the first locked position and second unlocked position, wherein the movable member overlies the indicium when the carrier member is in at least one of the first locked position and the second unlocked position, wherein the at least one locking receptacle is mounted on the one of the receptacle walls and the locking system is mounted on the cover.

26. The container of claim 25, wherein the carrier member slides to move between the first locked position and the second unlocked position.

27. The container of claim 25, wherein the locking system further comprises:

a blocking member disposed at a first end of the carrier member, the blocking member being positioned between a first engaged position in which the carrier member abuts a portion of the blocking member, thereby maintaining the carrier member in the first locked position and a second disengaged position in which the carrier member disengages from the blocking member and is movable to the second unlocked position.

28. The container of claim 25, further comprising a padlock that engages the carrier member in the first locked position.

* * * * *